US012390026B1

(12) United States Patent
Martinez

(10) Patent No.: US 12,390,026 B1
(45) Date of Patent: Aug. 19, 2025

(54) DOCUMENT HANGER

(71) Applicant: Catherine A. Martinez, El Dorado Hills, CA (US)

(72) Inventor: Catherine A. Martinez, El Dorado Hills, CA (US)

( * ) Notice: Subject to any disclaimer, the term of this patent is extended or adjusted under 35 U.S.C. 154(b) by 0 days.

(21) Appl. No.: 18/431,341

(22) Filed: Feb. 2, 2024

(51) Int. Cl.
*A47F 5/13* (2006.01)
*A47B 43/00* (2006.01)
*A47F 7/14* (2006.01)

(52) U.S. Cl.
CPC ..... *A47F 5/13* (2013.01); *A47B 43/006* (2013.01); *A47F 7/143* (2013.01)

(58) Field of Classification Search
CPC ... A47F 5/13; A47F 7/143; G09F 7/18; A47B 61/02; A47B 43/006; A47B 2051/005
USPC ..... 211/175, 119.13, 89.01, 11, 45, 118, 211/119.004, 119.009, 119.011, 85.2, 211/85.24, 106; 40/124, 617
See application file for complete search history.

(56) References Cited

U.S. PATENT DOCUMENTS 358,193 A * 2/1887 Gause ..... B60R 1/12 211/85.2
452,728 A * 5/1891 Parkinson ..... G09F 3/00 346/146
918,196 A * 4/1909 Price ..... A47F 7/163 211/45
933,500 A * 9/1909 Towle ..... G09F 7/22 24/546
1,393,136 A * 10/1921 Johnson ..... G08B 5/02 40/531
1,857,617 A * 5/1932 Berdon ..... D06F 57/08 211/119.011
1,980,587 A * 11/1934 Hayes ..... G03F 1/90 276/1
2,068,028 A * 1/1937 Jernson ..... D06F 57/12 211/104

(Continued)

OTHER PUBLICATIONS

New Classroom. Product Description [online]. Whitney Ward, Pinterest.com [retrieved on Feb. 3, 2023]. Retrieved from the Internet: <URL: https://www.pinterest.com/pin/161566705361208491/>.

(Continued)

*Primary Examiner* — Jennifer E. Novosad
(74) *Attorney, Agent, or Firm* — Cramer Patent & Design, PLLC.; Aaron R. Cramer

(57) ABSTRACT

The document hanger has a frame, one or more hanger lines, and a plurality of clips. The document hanger may be configured to display plurality of items simultaneously. As non-limiting examples, the plurality of items may be documents, reports, art projects, photographs, student works, certificates, other light-weight articles, or any combination thereof. As further non-limiting examples, the document hanger may be installed on a wall, on a bulletin board, over windows, or from a ceiling in a classroom, real estate office, business, event venue, or home. The one or more hanger lines may be stretched horizontally between a pair of vertical frame supports. The plurality of clips may be configured to couple individual items selected from the plurality of items to the one or more hanger lines. In some embodiments, the width and/or height of the frame may be adjustable.

1 Claim, 4 Drawing Sheets

(56) References Cited

U.S. PATENT DOCUMENTS 2,230,037 A * 1/1941 Hoeflich ..... D06F 57/12 211/99
2,270,796 A * 1/1942 Hauser ..... A47G 25/08 211/35
2,428,073 A * 9/1947 Handel ..... A47J 47/16 248/224.7
2,468,891 A * 5/1949 Neiser ..... D06F 57/12 211/104
2,675,130 A * 4/1954 Dore ..... A47G 25/18 211/118
2,848,118 A * 8/1958 Gibson ..... D06F 57/125 211/196
2,925,916 A * 2/1960 Pollock ..... A47B 61/02 211/119.004
3,079,004 A * 2/1963 Scott ..... D06F 57/12 211/119.009
3,146,890 A * 9/1964 Cowper ..... D06F 57/12 211/119.1
3,178,033 A * 4/1965 Wirsing ..... A47K 10/14 D6/326
3,339,745 A * 9/1967 Sugerman ..... A47F 7/02 211/85.2
3,782,558 A * 1/1974 Schael, Jr. ..... A47F 5/08 211/13.1
4,029,318 A * 6/1977 Boss ..... F41J 1/10 108/118
4,162,730 A * 7/1979 Steere, Jr. ..... D06F 57/12 211/118
4,463,855 A * 8/1984 Smithers ..... E06B 7/28 248/323
4,494,661 A * 1/1985 Krusche ..... A47F 5/083 248/220.31
4,872,963 A * 10/1989 Van Horn ..... C25D 17/08 118/503
5,253,750 A * 10/1993 Keffer ..... A47F 7/02 211/85.2
5,356,061 A * 10/1994 Yu ..... B60R 7/043 297/188.2
5,398,824 A * 3/1995 Wolff ..... A47F 5/0807 211/88.04
5,485,932 A * 1/1996 Romm ..... H02G 3/28 248/214
5,503,299 A 4/1996 Wentworth
5,551,772 A * 9/1996 Keffer ..... A47F 7/02 211/85.2
5,588,543 A * 12/1996 Finger ..... A47F 5/083 211/90.01
5,645,178 A * 7/1997 Conley, Jr. ..... A47G 25/746 248/490
5,967,342 A * 10/1999 Steffine ..... D06F 81/00 211/85.15
6,098,815 A * 8/2000 Nesser ..... A47B 61/04 211/38
6,299,001 B1 * 10/2001 Frolov ..... A47F 5/08 248/220.21
6,375,018 B1 * 4/2002 Clement ..... A47F 7/02 211/85.2
6,533,132 B1 * 3/2003 Weisenburger ..... F16B 12/34 248/340
7,000,787 B2 2/2006 Felsenthal
7,059,073 B2 * 6/2006 Beach ..... G09F 1/10 211/113
7,150,361 B2 * 12/2006 Calleja ..... A47F 7/0021 211/49.1
D566,767 S 4/2008 Urdarevik
7,757,870 B2 * 7/2010 Lin ..... C25D 17/08 211/118
7,931,161 B2 * 4/2011 Newbould ..... A47B 55/02 211/181.1
8,006,453 B2 * 8/2011 Anderson ..... G09F 7/18 52/39
D667,246 S * 9/2012 Cittadino ..... D6/513
8,627,950 B2 * 1/2014 Bland ..... A45C 11/16 211/85.2
8,657,124 B2 * 2/2014 Brown ..... A47G 25/005 211/85.3
8,714,367 B2 * 5/2014 Schulman ..... B43K 23/002 211/11
9,060,622 B2 6/2015 Neumann et al.
9,517,655 B2 * 12/2016 Manach ..... A47G 1/065
9,765,470 B1 9/2017 Dufresne
9,918,551 B2 * 3/2018 Hilliard ..... F16B 2/26
9,955,782 B2 5/2018 Rue et al.
10,094,064 B2 10/2018 Champagne et al.
10,334,973 B2 * 7/2019 Slevin-Giesler ..... A47B 43/006
10,421,184 B2 * 9/2019 Kwak ..... B25H 3/04
10,779,668 B2 * 9/2020 Erickson ..... A47G 25/746
11,071,398 B2 7/2021 Hicks et al.
11,337,531 B2 5/2022 Zhang et al.
11,877,653 B1 * 1/2024 Ardehali ..... A47B 96/061
2003/0164347 A1 * 9/2003 Bouvier, Jr. ..... B63B 32/83 211/187
2006/0186071 A1 * 8/2006 Rowan ..... A47G 29/00 211/113
2006/0207952 A1 * 9/2006 Timmons ..... A47F 5/0892 211/195
2007/0193969 A1 * 8/2007 Albanese ..... A47F 7/02 211/85.2
2007/0284326 A1 * 12/2007 Baloun ..... B65D 57/00 211/182
2008/0217272 A1 * 9/2008 Lam ..... A47G 25/743 211/118
2009/0200252 A1 * 8/2009 Blitz ..... A47F 7/19 211/85.3
2012/0267331 A1 * 10/2012 Cittadino ..... A47F 5/10 211/183
2013/0220957 A1 * 8/2013 Malik ..... A47B 96/16 211/119.004
2015/0282614 A1 * 10/2015 Wyner ..... A47B 61/003 211/85.3

OTHER PUBLICATIONS

Classroom Art Display. Product Description [online]. David Santos, Pinterest.com [retrieved on Feb. 3, 2023]. Retrieved from the Internet: <URL: https://www.pinterest.com/pin/553239135448990248/>.

* cited by examiner

DOCUMENT HANGER

RELATED APPLICATIONS

None.

FIELD OF THE DEVICE

The present device pertains to a document hanger and more specifically to a document hanger having adjustable features.

BACKGROUND OF THE DEVICE

There are many business, educational, and recreational settings where a wide range of lightweight materials need to be shown. Papers, photos, works of art, and many other things can be among these. Think about a teacher who wants to show off student work, a designer who wants to show a client a possible design idea, or an agent who is looking at evidence in a crime case. These are just a few examples, but they all have one thing in common: they all need to show things clearly so that they can be studied, appreciated, or talked about in more depth.

Using adhesives like tape has been the most popular way to deal with this problem in the past. These are stuck to vertical surfaces like windows, walls, whiteboards, and whiteboards to make them into temporary exhibition areas. There are some problems with this method, though.

To begin, it's hard on the body. Imagine having to climb up and down chairs and stools over and over again to get that picture or piece of paper to stick just right where everyone can see it. Putting things on display this way can be dangerous and time-consuming, especially if there are a lot of things to show.

Next, tapes are known for leaving behind leftovers. If you take down the tape, you might be left with a sticky, ugly mess, depending on the type of tape you used and the surface it was stuck to. Over time, this can lower the quality of the surfaces, which can hurt their look and function.

There is also the problem that this method is very rigid. This method doesn't give you a lot of freedom in changing environments where the way things are arranged might need to be changed all the time. Moving things around that are taped together is not only time-consuming, but it could also damage the items.

Moving from one place to another adds another barrier. It takes a long time to take down and re-set up the display every time someone moves, like a teacher to a different classroom or a businessperson to a different meeting room. And in the world we live in now, every minute is important. In order to deal with these problems, a better solution is needed. The development of the document hanger addresses this need in a manner that is safe, efficient, and cost effective.

SUMMARY OF THE DEVICE

The described invention pertains to a document hanger device designed primarily for displaying various items. The central embodiment features a vertically-oriented rectangular frame with an open center. This frame is notable for its adjustable vertical and horizontal supports. Stretched horizontally between these vertical supports are one or more hanger lines, designed for holding items via a series of clips. These hanger lines can be positioned and repositioned thanks to a range of wire couplers present on the vertical supports. A key functional feature includes detachable mounting hooks, which enable the device to be hung on either walls or ceilings.

Several embodiments emerge from this central design. The items to be displayed can encompass a range of lightweight materials, such as documents, art projects, photos, student assignments, certificates, among others. The device has versatility in its placement, being apt for environments like classrooms, homes, businesses, real estate offices, and event venues. In terms of its structure, the vertical supports of the frame can telescope and are equipped with height adjusters for easy modification of the frame's height. Similarly, the horizontal supports are designed to adjust in width.

Certain wire couplers on the device can be left unused, offering flexibility in positioning the hanger lines. If there's a need to adjust the width of the frame, the hanger lines can be replaced, cut, or even lengthened to accommodate. A particularly convenient feature is the ability to add or remove items from the hanger lines without needing to take down the entire device, or by simply adjusting the position of the frame. It can function as a single-sided display or a double-sided one, making it suitable as a room divider. Depending on manufacturing choices and requirements, the device's specifications, materials, and usage methods can vary. A notable material choice for the hanger lines includes durable options like wire, nylon, or polyethylene.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
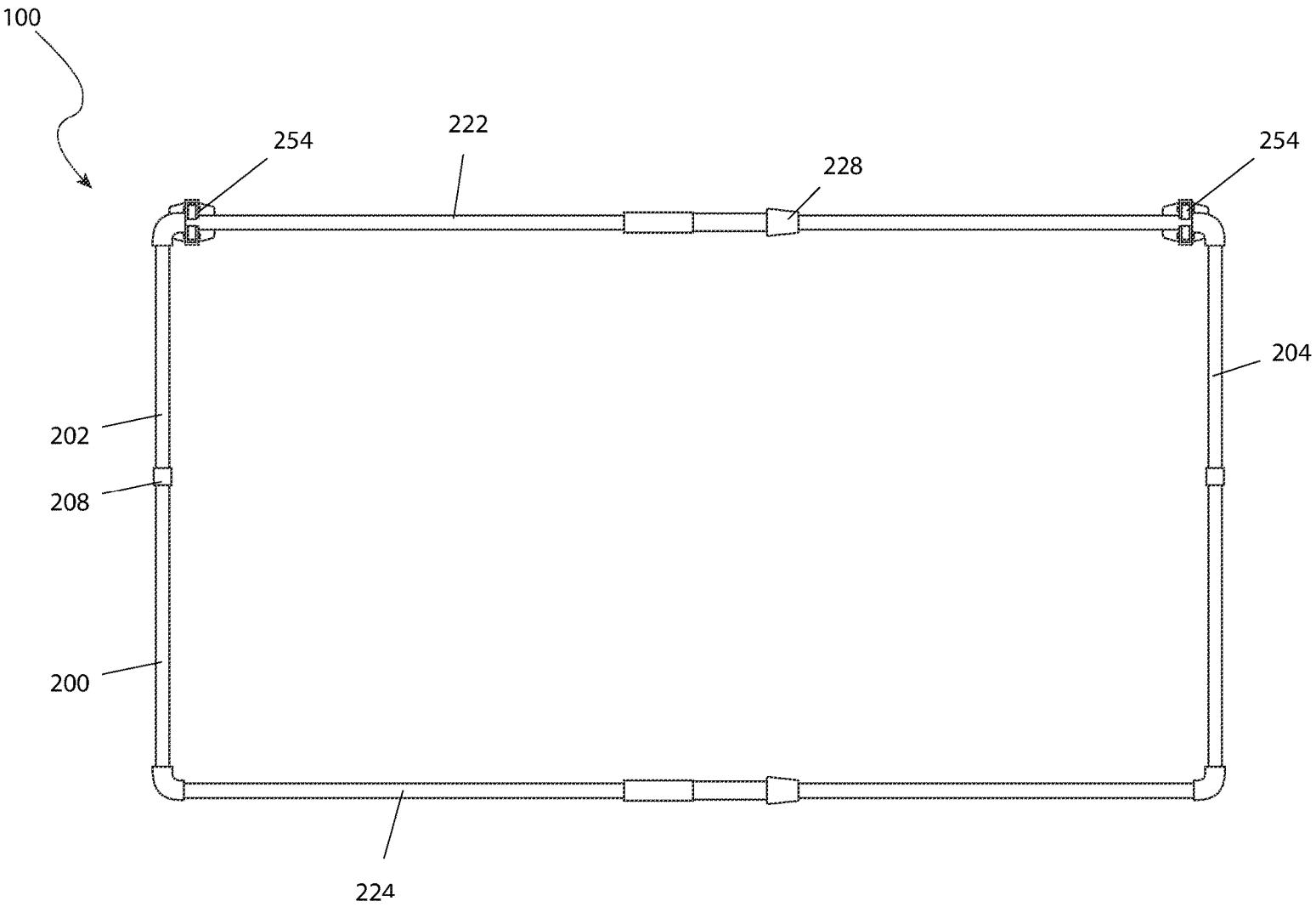
FIG. 1 is a front view of a document hanger 100, according to an embodiment of the present device, illustrating the frame 200.
Figure 3:
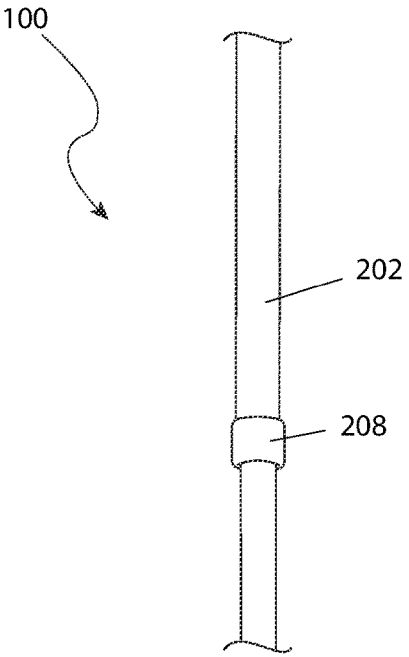
FIG. 3 is a detail view of a document hanger 100, according to an embodiment of the present device, illustrating the left side frame support 202 and a vertical frame support height adjuster 208.
Figure 2:
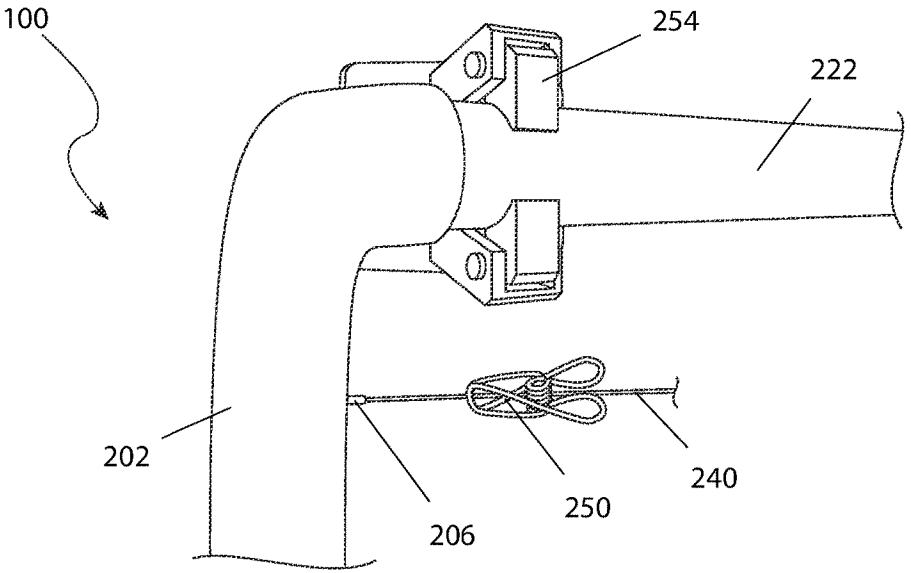
FIG. 2 is a detail view of a document hanger 100, according to an embodiment of the present device, illustrating one (1) or more hanger lines 240 and one (1) of a plurality of mounting hooks 254.
Figure 4:
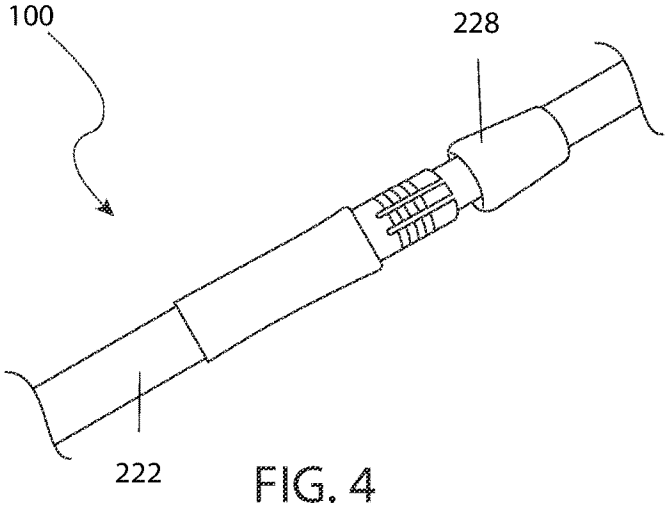
FIG. 4 is a detail view of a document hanger 100, according to an embodiment of the present device, illustrating the top frame support 222 and a horizontal frame support width adjuster 228.

100 document hanger
200 frame
202 left frame support
204 right frame support
206 plurality of wire couplers
208 vertical frame support height adjuster
222 top frame support
224 bottom frame support
228 horizontal frame support width adjuster
240 hanger line
250 clip

254 mounting hook
900 item
920 wall
922 window
930 ceiling

DESCRIPTION OF THE DEVICE

The present device is directed to a document hanger (herein described as the "device") 100. The device 100 may comprise a frame 200, one (1) or more hanger lines 240, and a plurality of clips 250. The device 100 may be configured to display plurality of items 900 simultaneously. As non-limiting examples, the plurality of items 900 may be documents, reports, art projects, photographs, student works, certificates, other light-weight articles, or any combination thereof. As further non-limiting examples, the device 100 may be installed on a wall 920, on a bulletin board, over windows 922, or from a ceiling 930 in a classroom, real estate office, business, event venue, or home using any suitable fastener such as a plurality of hooks (not shown). The hanger lines 240 may be stretched horizontally between a pair of vertical frame supports. The plurality of clips 250 may be configured to couple individual items selected from the plurality of items 900 to the hanger lines 240. In some embodiments, the width and/or height of the frame 200 may be adjustable.

The frame 200 may form a vertically-oriented rectangle with an open center. The hanger lines 240 may be stretched between opposing lateral sides of the frame 200. The frame 200 may retain the hanger lines 240 in predetermined positions. The frame 200 may determine the spacing between the hanger lines 240. The frame 200 may establish the overall dimensions of the device 100 and therefore may determine the capacity of the device 100.

The frame 200 may comprise a pair of vertical frame supports and a pair of horizontal frame supports. The pair of vertical frame supports may be vertically-oriented armatures comprising the lateral sides of the frame 200. The pair of vertical frame supports may comprise a left frame support 202 located on the left side of the frame 200 and a right frame support 204 located on the right side of the frame 200. The left frame support 202 may be oriented to be parallel to the right frame support 204.

An individual vertical frame support selected from the pair of vertical frame supports may comprise a plurality of wire couplers 206 where the hanger lines 240 couple to or pass through the frame 200. As non-limiting examples, the plurality of wire couplers 206 may comprise anchors, rivets, grommets, apertures, crimp sleeves, hooks, fittings, or any combination thereof.

In general, an individual wire coupler on the left frame support 202 may be paired with a corresponding individual wire coupler on the right frame support 204 and the hanger lines 240 may be stretched horizontally between the individual wire couplers on the left frame support 202 and the corresponding individual wire couplers on the right frame support 204.

In some embodiments, one (1) or more of the plurality of wire couplers 206 may be left unpopulated such that the hanger lines 240 may be repositionable. In this context, unpopulated may refer to the fact that the hanger lines 240 do not pass through an unpopulated wire coupler.

In some embodiments, the individual vertical frame support may be adjustable such that the height of the frame 200 may be changed. As a non-limiting example, the individual vertical frame support may be divided into two (2) or more telescoping vertical segments joined by vertical frame support height adjusters 208. The vertical frame support height adjusters 208 may be loosened to permit individual vertical segments of the individual vertical frame support to slide in a manner that lengthens or shortens the individual vertical frame support. The vertical frame support height adjusters 208 may then be tightened to retain an established height for the frame 200.

The pair of horizontal frame supports may be horizontally-oriented armatures. The pair of horizontal frame supports may comprise a top frame support 222 located on the top of the frame 200 and a bottom frame support 224 located at the bottom of the frame 200. The top frame support 222 may be oriented to be parallel to the bottom frame support 224. The top frame support 222 and the bottom frame support 224 may be oriented to be perpendicular to the left frame support 202 and the right frame support 204.

In some embodiments, an individual horizontal frame support selected from the top frame support 222 and the bottom frame support 224 may be adjustable such that the width of the frame 200 may be changed. As a non-limiting example, the individual horizontal frame support may be divided into two (2) or more telescoping horizontal segments joined by horizontal frame support width adjusters 228. The horizontal frame support width adjusters 228 may be loosened to permit individual horizontal segments of the individual vertical frame support to slide in a manner that lengthens or shortens the individual horizontal frame support. The horizontal frame support width adjusters 228 may then be tightened to retain an established width for the frame 200.

As non-limiting examples, the hanger lines 240 may be made of wire or a monofilament polymer such as nylon or polyethylene. In some embodiments, the hanger lines 240 may be coupled between the left frame support 202 and the right frame support 204 at each height on the frame 200 where the hanger lines 240 appear and the hanger lines at each height may be independent of all other hanger lines. Alternatively, a single hanger line may be threaded back and forth through the frame 200 such that the single hanger line appears at each height in the frame 200 where the hanger lines 240 appear.

As non-limiting examples, the hanger lines 240 may be replaced, cut, lengthened from a surplus length coupled to the frame 200, or any combination thereof when necessitated due to changing the width of the frame 200. A plurality of mounting hooks 254 may detachably couple to the frame 200 to suspend the frame 200 from the wall 920 or the ceiling 930 for viewing.

The plurality of clips 250 may be configured to detachably couple the plurality of items 900 to the hanger lines 240. The plurality of items 900 may be displayed on the front side of the device 100, on the rear side of the device 100, or both. The plurality of items 900 may be coupled to the device 100 and decoupled from the device 100 while the device 100 is suspended from the plurality of mounting hooks 254. Alternatively, the frame 200 may be lowered to change the plurality of items 900 by decoupling the frame 200 from the plurality of mounting hooks 254. As a non-limiting example, the frame 200 may be lowered using one (1) or more reaching tools that comprise an extension pole with a forked end to lower the frame 200 from the plurality of mounting hooks 254 and to lift the frame 200 onto the plurality of mounting hooks 254.

In use, the plurality of mounting hooks 254 may be coupled to a wall 920 or to a ceiling and the frame 200 may be detachably coupled to the plurality of mounting hooks

254. Plurality of items 900 may be detachably coupled to the hanger lines 240 such that the plurality of items 900 are displayed for viewing. The plurality of items 900 may be display on a single side of the frame 200 or on both sides of the frame 200. As a non-limiting example, the frame 200 may be suspended from the ceiling to form a room divider and the plurality of items 900 may be coupled to both sides of the frame 200.

In some embodiments, the height and/or width of the frame 200 may be changed by loosening the vertical frame support height adjusters 208, the horizontal frame support width adjusters 228, or both and telescoping the individual vertical frame supports and/or the individual horizontal frame supports to lengthen and/or shorten side of the frame 200. In some embodiments, resizing the frame 200 may necessitate changing the length of the hanger lines 240. As non-limiting examples, the hanger lines 240 may be replaced, cut, lengthened from a surplus length coupled to the frame 200, or any combination thereof when necessitated due to changing the width of the frame 200.

Figure 5:
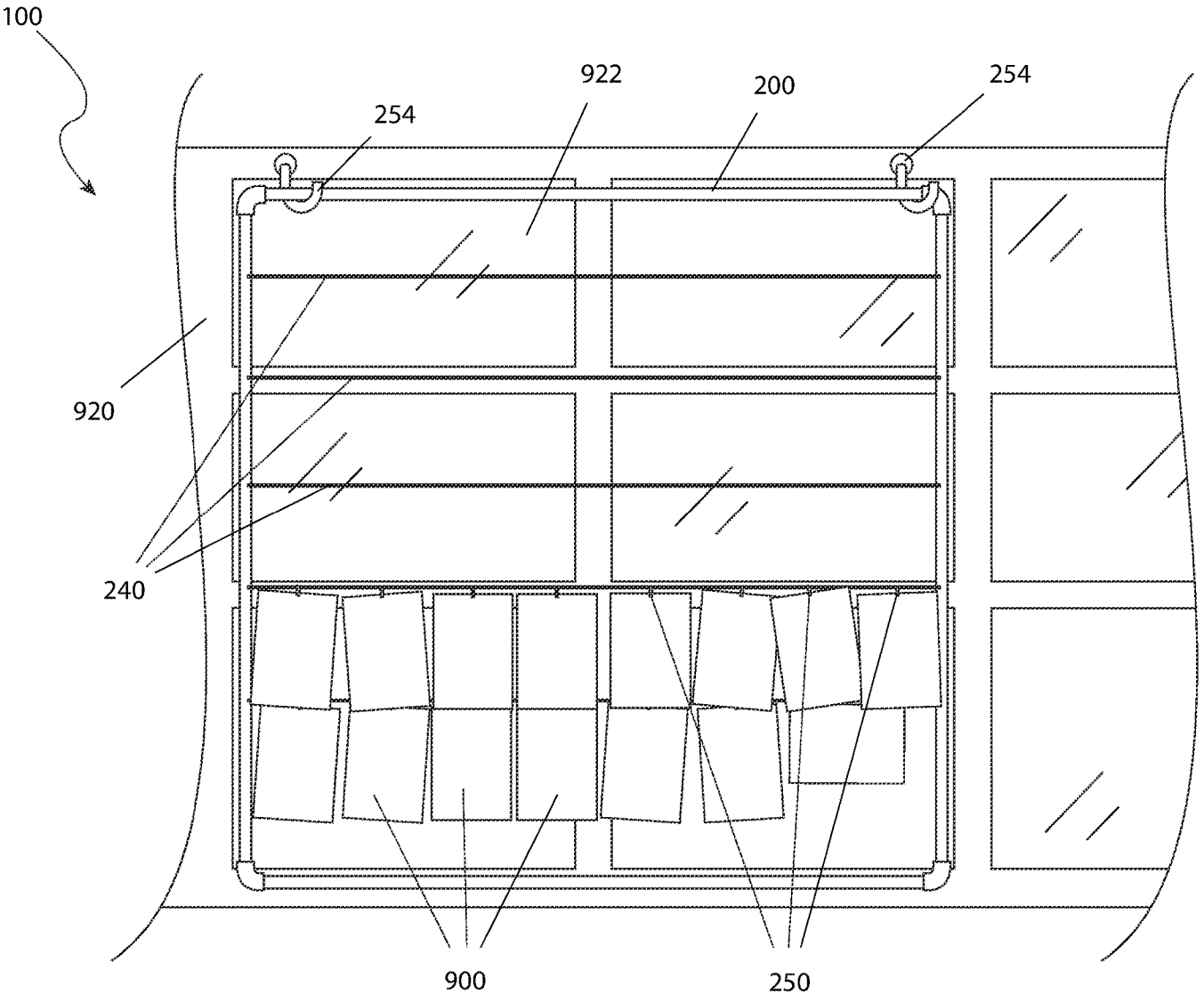
FIG. 5 is an in-use view of a document hanger 100, according to an embodiment of the present device.
Figure 6:
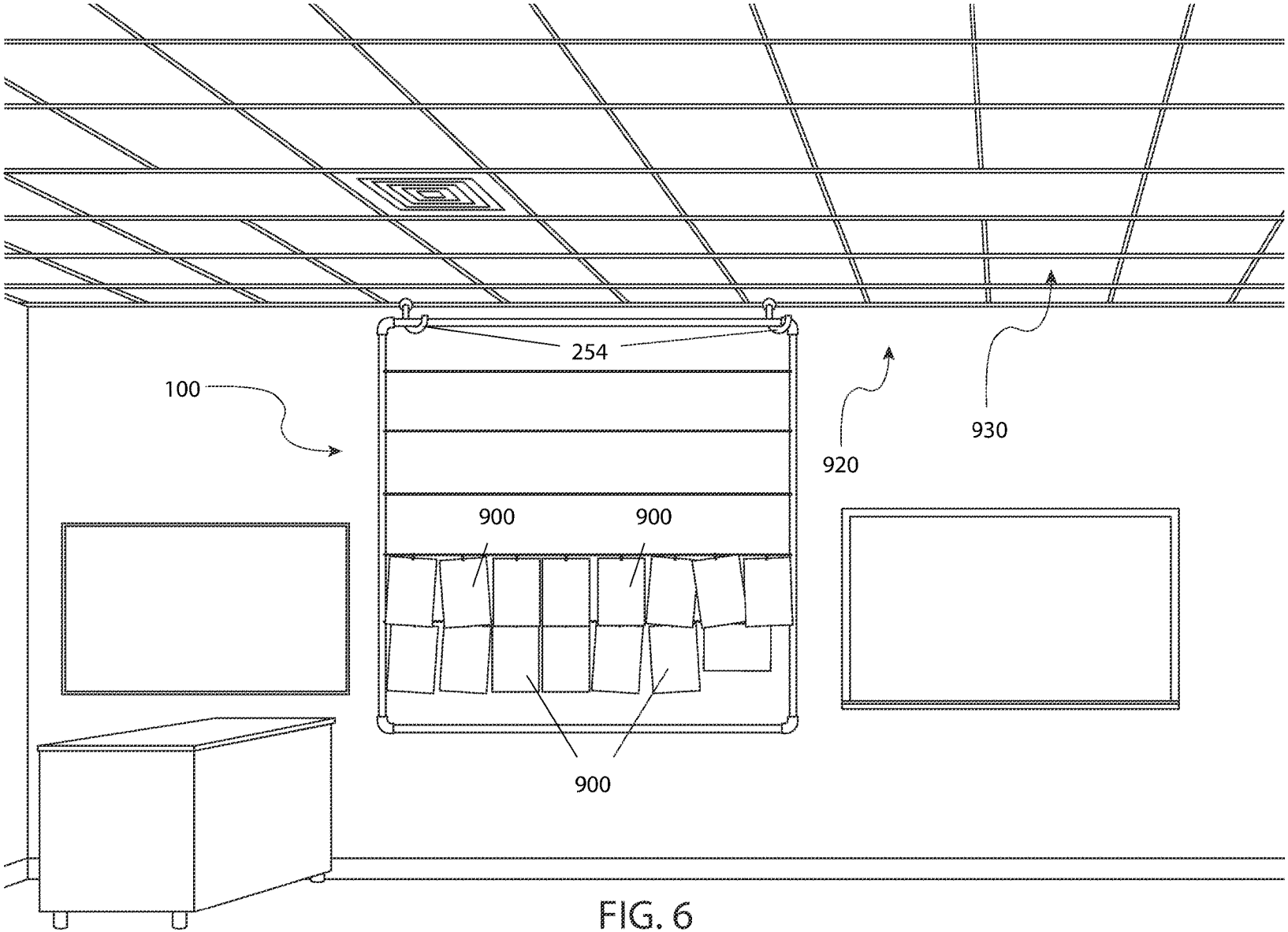
FIG. 6 is an alternate in-use view of a document hanger 100, according to an embodiment of the present device.

Referring now to FIGS. 5 and 6, the plurality of items 900 may be added and/or removed from the hanger lines 240 while the frame 200 is suspended from the wall 920 or the ceiling 930. Alternatively, the frame 200 may be lowered and replaced using one (1) or more reaching tools.

The exact specifications, materials used, and method of use of the device 100 may vary upon manufacturing. The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A document hanger device consisting of:

a vertically-oriented rectangular frame having an open center and consisting of a pair of vertical frame supports and a pair of horizontal frame supports;

a plurality of wire couplers positioned along at least one of the vertical frame supports;

a plurality of hanger lines extending horizontally between corresponding wire couplers on the vertical frame supports;

a plurality of clips coupled to the hanger lines and configured to detachably secure one or more display items to the hanger lines; and, a plurality of detachable mounting hooks configured to suspend the frame from a wall or ceiling; and, wherein the pair of vertical frame supports are parallel to each other and oriented perpendicular to the pair of horizontal frame supports;

wherein the frame is detachable from the mounting hooks to allow for repositioning or replacement of the display items;

wherein at least one of the vertical frame supports and at least one of the horizontal frame supports consist of telescoping segments joined by frame adjusters configured to allow selective adjustment of a height and a width of the frame;

wherein the hanger lines are repositionable by selectively coupling to different wire couplers, and one or more of the wire couplers are left unpopulated when the hanger lines are not coupled thereto;

wherein each of the hanger lines is made of wire or monofilament polymer; and, wherein the display items are removably attachable to the hanger lines while the frame is suspended from the mounting hooks or while the frame is detached therefrom.

* * * * *